US006773293B1

(12) United States Patent
Lee

(10) Patent No.: US 6,773,293 B1
(45) Date of Patent: Aug. 10, 2004

(54) CABLE END CONNECTOR WITH LOCKING MEMBER

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/393,597

(22) Filed: Mar. 20, 2003

(51) Int. Cl.[7] ..... H01R 13/627
(52) U.S. Cl. ..... 439/357
(58) Field of Search ..... 439/350–358, 439/369, 370

(56) References Cited

U.S. PATENT DOCUMENTS 5,435,744 A * 7/1995 Derstine et al. ..... 439/352
5,445,534 A 8/1995 Ishizuka et al.
5,672,071 A 9/1997 Ceru
5,775,931 A 7/1998 Jones
5,924,886 A 7/1999 Achammer et al.
6,257,914 B1 * 7/2001 Comerci et al. ..... 439/357
6,431,887 B1 8/2002 Yeomans et al.
6,585,536 B1 * 7/2003 Wu ..... 439/358

* cited by examiner

*Primary Examiner*—Ross Gushi
(74) *Attorney, Agent, or Firm*—Wei Te Chung

(57) ABSTRACT

A cable end connector (100) for mating with a complementary connector (7) includes an insulative housing (1), a number of contacts (4) disposed in the housing, a cable (6) having a number of signal and grounding conductors (61, 62) electrically connected to the contacts, a cover (5) partially enclosing the housing, and a locking member (2). The locking member includes a securing portion fixed secured to the insulative housing, and a one-mated latching portion (22) movably extending forwardly from the securing portion and out of the housing for locking with the complementary connector permanently.

22 Claims, 7 Drawing Sheets

CABLE END CONNECTOR WITH LOCKING MEMBER

BACKGROUND OF THE INVENTION

1. Field of the Invention

The present invention relates to a cable end connector, and particularly to a cable end connector with a locking member for locking with a complementary connector.

2. Description of Related Art

Complementary electrical connectors typically include dielectric housings respectively receiving a plurality of terminals or contacts which, when the connectors are mated, establish an electrical connection therebetween. The complementary connectors may be male and female connectors or plug and receptacle connectors. In some instances, the connectors have complementary latches for locking the connectors together when mated. U.S. Pat. Nos. 5,445,534, 5,775,931, 5,924,886 and 6,431,887 disclose different forms of latch structures to provide a reliable mechanical and electrical connection between complementary connectors.

There exists in the art an electrical connector known as a Serial Advanced Technology Attachment (Serial ATA) connector which is generally used for disk drives and storage peripherals. Especially, the Serial ATA connectors according the Serial ATA standard are featured in fewer electrical contacts than other conventional electrical connectors and are relatively tiny in configurations. It is desirable for the Serial ATA connector to have latching means for providing a reliable mechanical and electrical connection with a complementary connector. However, the latch structures disclosed in the above-mentioned patents are not fully suitable for the Serial ATA connector. For example, the latch structure of U.S. Pat. No. 5,445,534 is used for locking a male component in a female housing. The other latch structures are relatively complex or cannot used in the Serial ATA connector because of the specific structure of Serial ATA.

Therefore, assignee of the present application has proposed several solutions to satisfy current demands in, for example, U.S. patent application Ser. Nos. 10/301,221, 10/280,515, 10/271,064, and 10/241,551, filed respectively on Nov. 20, 2002, Oct. 24, 2002, Oct. 15, 2002 and Sep. 11, 2002, and respectively entitled "ELECTRICAL CONNECTOR ASSEMBLY HAVING LOCKING MEMBER", "CABLE END CONNECTOR WITH LOCKING MEMBER", "CABLE END CONNECTOR WITH LOCKING MEMBER" and "CABLE END CONNECTOR WITH LOCKING MEMBER".

The Serial ATA cable end connector of the above-mentioned applications generally comprises a housing, a plurality of terminals, a cable comprising a plurality of conductors respectively electrically connecting to the terminals, a cover over-molded with the housing and the cable, and a locking member. The locking member comprises a pushing portion received in a recess of the cover and a locking portion for releasing/locking the cable end connector from/with the complementary connector conveniently by way of the pushing portion. However, sometimes Serial ATA connectors are used in a chassis of a host computer. In such a condition, once the cable end connector has been engaged with the complementary connector, it doesn't need to separate the cable end connector often from the complementary connector. Thus, a suitable type of locking member is needed to satisfy this different demand.

SUMMARY OF THE INVENTION

An object, therefore, of the present invention is to provide a cable end connector with a locking member for locking the connector with a complementary connector permanently.

In order to achieve the objects set forth, a cable end connector for mating with a complementary connector comprises an insulative housing, a plurality of contacts disposed in the housing, a cable comprising a plurality of conductors electrically connected to the contacts, a cover partially enclosing the housing, and a locking member. The locking member comprises a securing portion fixedly secured to the insulative housing, and a latching portion movably extending from the securing portion and out of the insulative housing for locking with the complementary connector and providing a mechanical connection therebetween.

Other objects, advantages and novel features of the invention will become more apparent from the following detailed description when taken in conjunction with the accompanying drawings.

DETAILED DESCRIPTION OF THE PREFERRED EMBODIMENT

Figure 1:
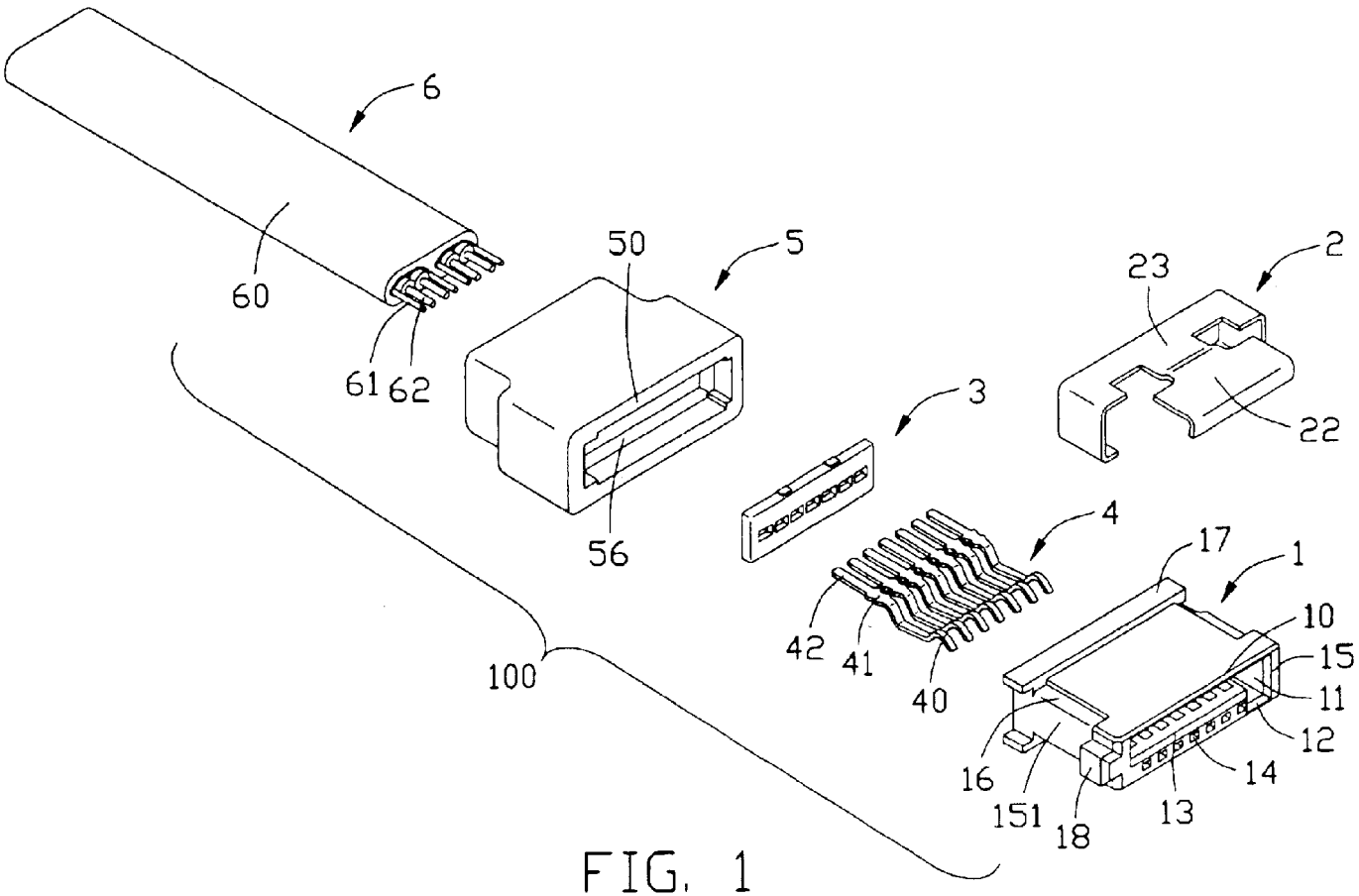
FIG. 1 is an exploded, perspective view of a cable end connector in accordance with the present invention.
Figure 4:
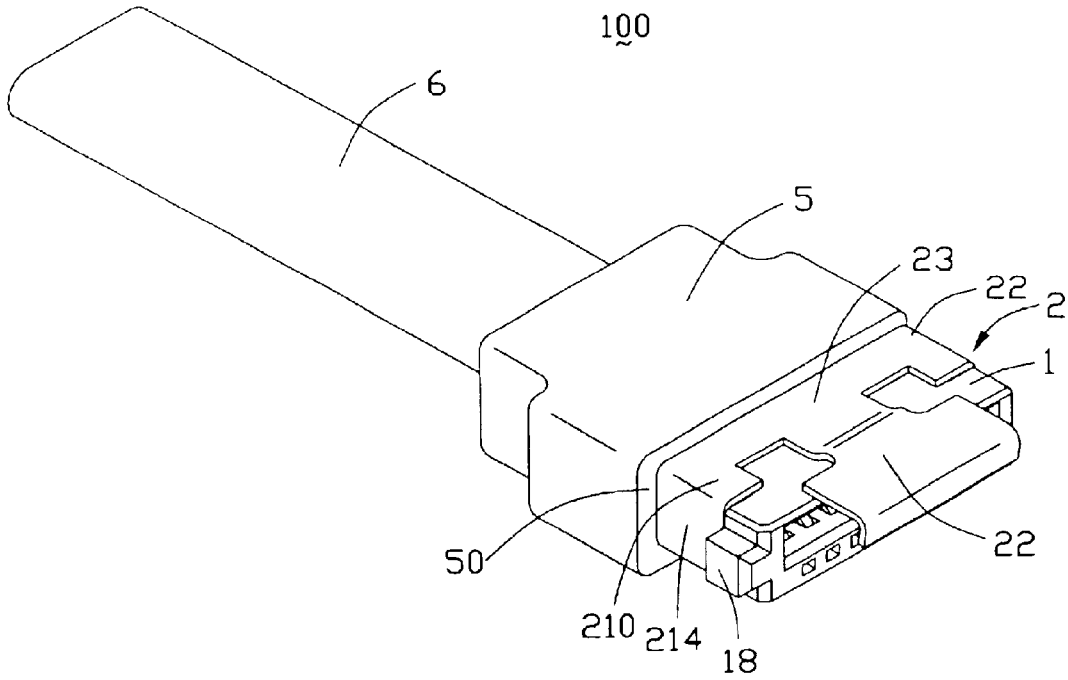
FIG. 4 is an assembled view of the cable end connector of FIG. 1.

Referring to FIG. 1 and FIG. 4, a cable end connector 100 in accordance with the present invention comprises an insulative housing 1, a locking member 2, a spacer 3, a plurality of contacts 4, a cover 5, and a cable 6.

Figure 2:
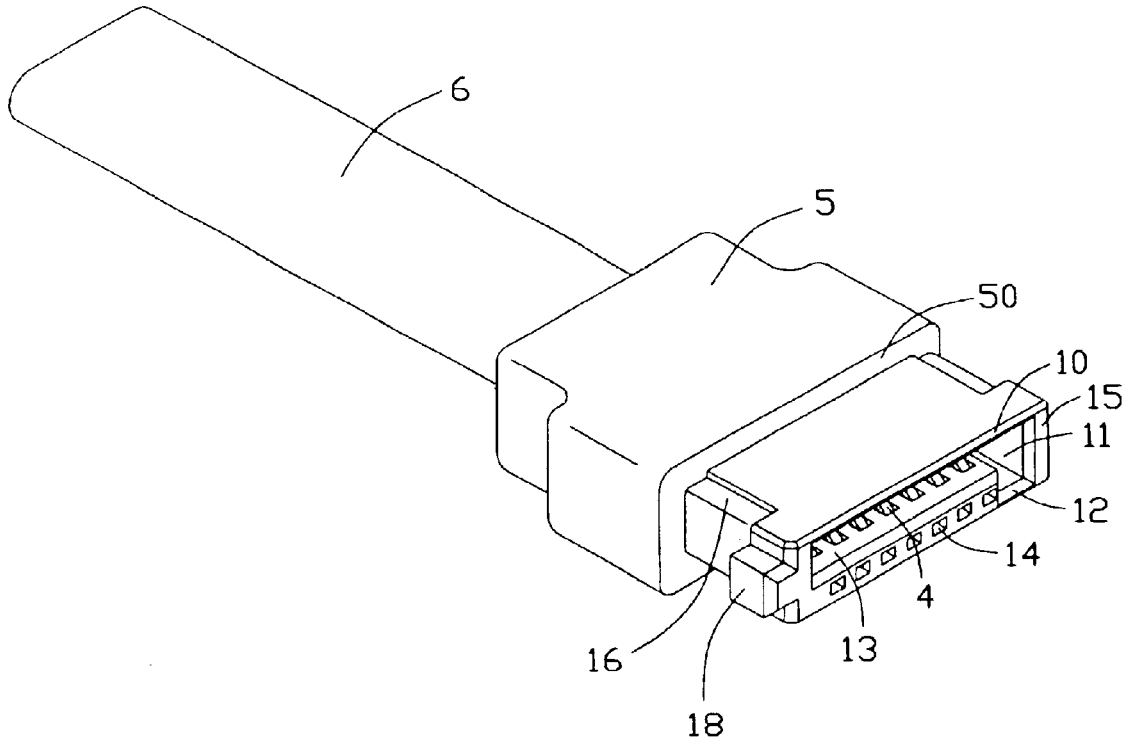
FIG. 2 is an assembled, perspective view of the cable end connector of FIG. 1, without a locking member thereof.
Figure 7:
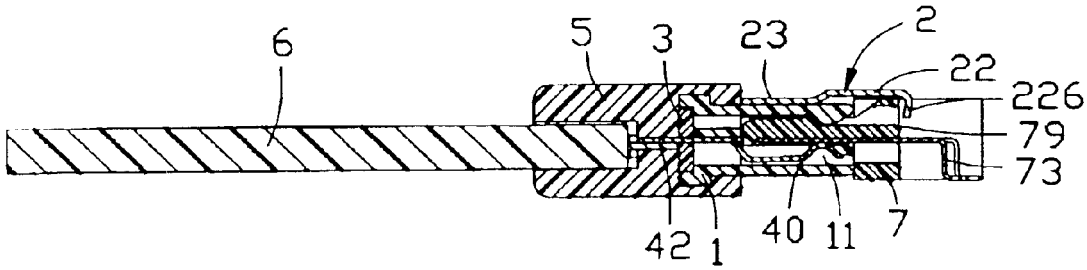
FIG. 7 is a cross-sectional view taken along line 7—7 of FIG. 6.

Referring to FIGS. 1–2 and in conjunction with FIG. 7, the insulative housing 1 is a rectangular body and comprises an upper wall 10, a lower wall 12 opposite to the upper wall 10, and a pair of side walls 15 joining the upper and lower walls 10, 12. An L-shaped receiving space 11 is defined between the upper and lower walls 10, 12 for receiving the complementary connector 7. A block 13 is formed on the lower wall 12 and protrudes into the receiving space 11. A plurality of passageways 14 is defined through the block 13 for receiving the contacts 4. Each side wall 15 is partly cut off to define a channel 151. The upper and lower walls 10, 12 each defines a pair of recesses 16 communicating with a corresponding channel 151 on a pair of sides thereof. A guiding projection 18 protrudes sidewardly from a side surface of the side wall 15. A pair of ribs 17 is formed on an upper surface and a lower surface of the housing 1 and adjacent to a rear portion of the housing 1 for engaging with the cover 5, and a receiving slot (not labeled) is defined in the rear portion of the housing 1 for receiving the spacer 3.

The spacer 3 is a rectangular board defining a plurality of holes therethrough. Each contact 4 comprises a retention portion 41 for engaging with a corresponding passageway 14 defined in the block 13, a mating portion 40 extending forwardly from the retention portion 41 for being received in corresponding passageway 14 and partly exposed into the receiving space 11, and a tail portion 42 extending rearwardly from the retention portion 41 for electrically contacting the cable 6.

The cable 6 comprises two differential pairs and an outer insulative jacket 60 surrounding the pairs. Each differential pair comprises a pair of signal conductors 62 and a pair of grounding conductors 61 arranged beside the signal conductors 62. Each conductor extends beyond a front end of the jacket 60.

The cover 5 is preferably formed of molded plastic or polymer material and is over-molded with the rear portion of the housing 1 and the front end of the cable 6. The cover 5 is a rectangular body and a transverse size of a rear portion thereof is smaller than a transverse size of a front portion thereof for being grasped conveniently and receiving the cable 6 therein.

Figure 3:
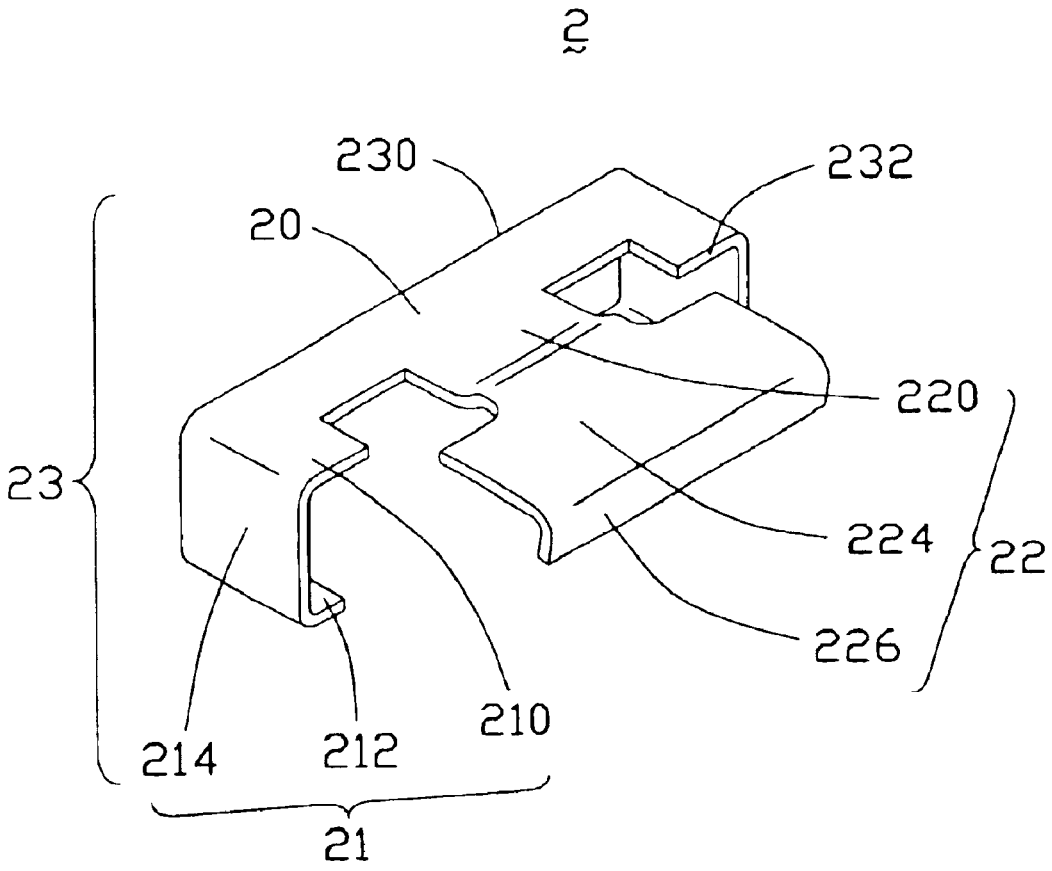
FIG. 3 is a perspective view of the locking member of the cable end connector.

Referring to FIGS. 1 and 3, the locking member 2 comprises a securing portion 23 for securing the locking member 2 to the housing 1 and a latching portion 22 extending forwardly from a middle of the securing portion 23. The securing portion 23 comprises a transverse portion 20 and a pair of side portions 21 extending sidewardly from opposite lateral edges of the transverse portion 20. Each side portion 21 comprises a U-shaped claw having opposite first and second portions 210, 212, and a vertical portion 214 connecting the first and second portions 210, 212. The first portion 210 extends sidewardly from the lateral edge of the transverse portion 20. The second portion 212 is opposite to the first portion 210. The latching portion 22 comprises a neck portion 220, an enlarged portion 224 extending forwardly from the neck portion 220, and a hook portion 226 bent downwardly from a free end of the enlarged portion 224 for locking with the complementary connector 7.

Referring to FIGS. 1–4, and in conjunction with FIG. 7, in assembly, the contacts 4 are first assembled into the housing 1 in a rear-to-front direction. The mating portion 40 and the retention portion 41 of each contact 4 are received into corresponding passageway 14 and the tail portion 42 exposed outside the housing 1. The spacer 3 is then received into the receiving slot defined in the rear portion of the housing 1, and the tail portions 42 of the contacts 4 protrude through the holes defined in the spacer 3. The spacer 3 seals the rear portion of the insulative housing 1, thereby efficiently preventing the melted plastic material of the cover 5 from entering into the housing 1 when the cover 5 is being molded. The signal and grounding conductors 61, 62 of the cable 6 are soldered to the tail portions 42, respectively. The cover 5 is then over-molded with the rear portion of the housing 1 and the front end of the cable 6. Melted material of the cover 5 is received in the channel 151. The pair of ribs 17 is received in a receiving cavity 56 defined by four walls of the cover 5 and engaging with inner surfaces of the receiving cavity 56. Therefore, the cover 5 engages with the cable 6 and the housing 1 reliably.

The locking member 2 is then assembled to the housing 1. The transverse portion 20 of the securing portion 23 filly attached to the upper surface of the housing 1. The vertical portion 214 of the side portion 21 is received in the channel 151. The first and second portions 210, 212 of each side portion 21 are respectively received in the recesses 16 defined in the upper and lower surfaces of the housing 1. Opposite first and second edges 230, 232 of the securing portion 23 of the locking member 2 respectively abut against a front surface 50 of the cover 5 and front portions of the insulative housing 1. Thus, the locking member 2 is secured between the insulative housing 1 and the cover 5 for preventing from moving along a front-to-rear direction. The enlarged portion 224 of the latching portion 22 extends beyond a front end of the housing 1 for locking with the complementary connector 7.

Figure 5:
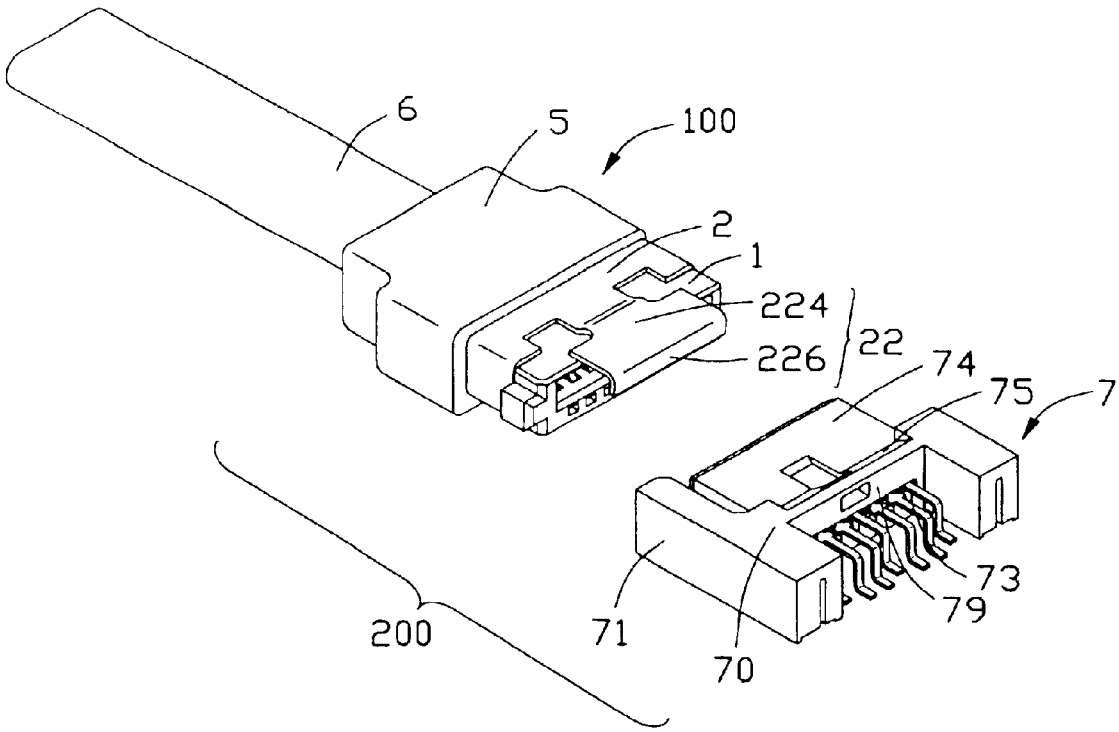
FIG. 5 is a perspective view of the cable end connector in accordance with the present invention and a complementary connector, which together constitute an electrical connector assembly.
Figure 6:
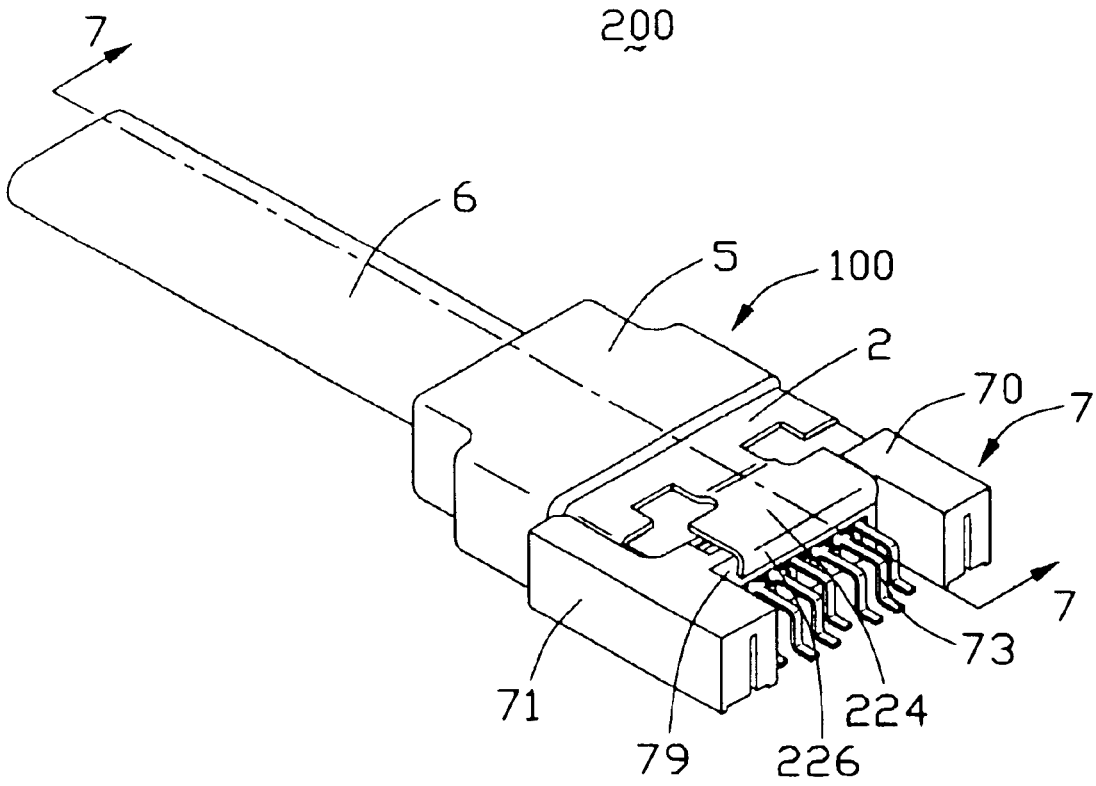
FIG. 6 is a view similar to FIG. 5 but the cable end connector and the complementary connector have been mated with each other.

Referring to FIGS. 5–7, the complementary connector 7 and the cable end connector 100 in accordance with the present invention together constitute an electrical connector assembly 200. The complementary connector 7 comprises a dielectric housing 70 and a tongue 74 extending forwardly from a middle of the housing 70. A guiding post 71 extends forwardly from one end of the housing 70 for facilitating the engagement with the cable end connector 100. A guide portion 75 is formed on the housing 70 and is chamfered in configuration and has an inclined surface, functioning in guiding and facilitating the hook portion 226 of the locking member 2 to lock with the complementary connector 7. A plurality of terminals 73 is assembled to the housing 70 and each terminal 73 has a solder tail in Surface Mount type extending beyond a rear surface 79 of the housing 70 for being soldered to a surface of a printed circuit board (not shown).

In use, referring to FIGS. 5–7, when the cable end connector 100 is to mate with the complementary connector 7, the tongue 72 with the terminals 73 aligns with the receiving space 11 of the housing 1 of the cable end connector 100. The hook portion 226 of the locking member 6 slides through the inclined surface of the chamfered guide portion 75 of the complementary connector 7 and then snapped onto the rear surface 79 of the housing 70. In such a way, the one-mated locking member 6 of the cable end connector 100 is smoothly and securely locked with the complementary connector 7. A permanent engagement between the cable end connector 100 and the complementary connector 7 is formed by the locking member 2. Since there is no possibility of the latching portion 22 locking/separating with/from the complementary connector 7 repeatedly, after the locking member 2 locks with the complementary connector 7, only the latching portion 22 of the locking member 2 is destroyed to deform upwardly, the cable end connector 1 can be separated from the complementary connector 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector for mating with a complementary connector, comprising:

an insulative housing;

a plurality of contacts disposed in the housing;

a cable comprising a plurality of conductors electrically connected to the contacts, respectively;

a cover partially enclosing the housing; and a locking member comprising a securing portion and a latching portion movably extending from the securing portion and out of the insulative housing and adapted for locking with the complementary connector permanently, the securing portion comprising a transverse portion abutting against an upper surface of the insulative housing and a pair of U-shaped claws extending sidewardly from the transverse portion to surround side surfaces of the insulative housing, each claw having opposite first and second portions and a vertical portion connecting the first and the second portions.

2. The cable end connector as claimed in claim 1, wherein the cover is over-molded with a rear portion of the housing and a front end of the cable.

3. The cable end connector as claimed in claim 1, wherein the securing portion of the locking member comprises a first edge abutting against a front surface of the cover.

4. The cable end connector as claimed in claim 1, wherein the housing comprises a guiding projection protruding sidewardly from a side surface of the side wall and adapted for engaging with a corresponding guiding portion of the complementary connector.

5. The cable end connector as claimed in claim 1, wherein the conductors of the cable comprise a plurality of signal conductors for signal transmission and a plurality of grounding conductors.

6. The cable end connector as claimed in claim 1, wherein said insulative housing comprises an upper wall, a lower wall opposite to the upper wall, and a pair of side walls joining the upper and lower walls, each side wall is partly cut off to define a channel, and the vertical portion of the U-shaped claw is correspondingly received in the channel.

7. The cable end connector as claimed in claim 6, wherein the insulative housing defines an L-shaped receiving space between the upper and lower walls.

8. The cable end connector as claimed in claim 6, wherein an upper and a lower surfaces of the housing each define a pair of recesses, and the first and second portions of the U-shaped claw are received in the recesses of the housing.

9. The cable end connector as claimed in claim 1, wherein the latching portion comprises a neck portion, an enlarged portion extending forwardly from the neck portion, and a hook portion bent downwardly from the enlarged portion and adapted for locking with the complementary connector.

10. The cable end connector as claimed in claim 9, wherein the housing comprises a block on the lower wall thereof and protruding into the receiving space, and a plurality of passageways defined through the block for receiving the contacts therein.

11. The cable end connector as claimed in claim 10, wherein each contact comprises a retention portion engaging with a corresponding passageway of the block of the housing, a mating portion extending forwardly from the retention portion and received in the corresponding passageway, and a tail portion extending rearwardly from the retention portion and exposed outside the housing for connecting to the conductors of the cable.

12. The cable end connector as claimed in claim 11, further comprising a spacer assembled to the rear portion of the housing for preventing melted plastic material of the cover from entering into the housing.

13. The cable end connector as claimed in claim 1, wherein the cover defines a receiving cavity, the housing comprises a pair of ribs formed on the upper and lower surfaces thereof and adjacent to the rear portion, and the ribs are received into the receiving cavity and engage with inner surfaces of the cover.

14. The cable end connector as claimed in claim 13, wherein the spacer defines a plurality of holes and wherein the tail portions of the contacts protrude through the holes, respectively.

15. An electrical connector assembly, comprising:

a cable end connector comprising:

an insulative housing;

a plurality of contacts disposed in the insulative housing;

a cover molded with the insulative housing;

a cable comprising a plurality of conductors electrically connected to the contacts; and a locking member comprising a securing portion fully attached to an outer surface of the insulative housing and fixedly secured to the insulative housing, and a latching portion extending out of the insulative housing; and a complementary connector engagable with the cable end connector and comprising a dielectric housing and a plurality of terminals retained to the dielectric housing and mating with the contacts of the cable end connector, the dielectric housing comprising a guide portion forming an inclined surface on which the latching portion of the locking member slides before the locking member filly locks with the complementary connector.

16. The electrical connector assembly as claimed in claim 15, wherein the dielectric housing of the complementary connector comprises a rear surface, and the latching portion of the locking member comprises a hook portion snapping onto the rear surface.

17. The electrical connector assembly as claimed in claim 16, wherein the hook portion of the locking member slides on the inclined surface of the guide portion before the locking member filly locks with the complementary connector.

18. The electrical connector assembly as claimed in claim 15, wherein the complementary connector comprises a tongue extending forwardly from the dielectric housing and receiving the terminals.

19. A cable end connector for mating with a complementary connector, comprising:

an insulative housing;

a plurality of contacts disposed in the housing;

a cable comprising a plurality of conductors electrically connected to the contacts, respectively;

a cover over-molded with the insulative housing and comprising a front surface; and a locking member comprising a securing portion fixedly secured to the insulative housing and a latching portion extending from the securing portion adapted for locking with the complementary connector, wherein the securing portion comprises a first edge abutting against the front surface of the cover.

20. A connector assembly comprising:

a first connector including a first housing with a plurality of first contacts therein;

a locking member including a securing portion attached to said first housing, and a latching portion extending form said securing portion forwardly, said latching portion being deflectable relative to the securing portion in a first direction, a hook portion located around a free end of said latching portion a second connector including a second housing with a plurality of second contacts therein;

a locking face provided on the second housing;

a slanted guide portion provided on at least one of said second housing and said latching portion; wherein during mating of said first and second connectors along a second direction perpendicular to said first direction, initially the latching portion is deflected in said first direction due to said guide portion, and resumes after the first connector and the second connectors are fully mated so as to have the hook portion latchably engaged with the locking face under a condition that no means is provided on either the first connector or the second connector to allow a user to easily manually deflect said latching portion for disengaging the first and second connectors from each other.

21. The assembly as claimed in claim 20, wherein said latching portion is exposed to an exterior while being hard to be deflected once said first and second connectors are fully mated.

22. The assembly as claimed in claim 20, wherein said locking face is a rear face of the second housing, and the latching portion forwardly extends beyond the first housing.

* * * * *